US006300919B1

(12) United States Patent
Mehen et al.

(10) Patent No.: US 6,300,919 B1
(45) Date of Patent: Oct. 9, 2001

(54) HIGHLY ISOLATED DUAL COMPACT STACKED SPIRAL ANTENNA

(75) Inventors: Michael S. Mehen; Gary Salvail; Mark Kusbel, all of Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/578,133

(22) Filed: May 23, 2000

(51) Int. Cl.[7] ..... H01Q 1/36
(52) U.S. Cl. ..... 343/895; 343/821
(58) Field of Search ..... 343/728, 729, 343/872, 789, 821, 860, 895

(56) References Cited

U.S. PATENT DOCUMENTS 3,686,674 * 8/1972 Clasby et al. ..... 343/895
4,797,684 * 1/1989 Bernstein et al. ..... 343/895
5,936,594 8/1999 Yu et al. ..... 343/895
5,990,849 11/1999 Salvail et al. ..... 343/895

* cited by examiner

*Primary Examiner*—Tan Ho
(74) *Attorney, Agent, or Firm*—William J. Benman; Glenn H. Lenzen, Jr.

(57) ABSTRACT

An antenna is described which includes a plurality of antennas stacked on top of each other in a compact cavity. Input match and radiation gain can be enhanced by the application of a capacitor and inductor in the feed of the spiral lowest in the cavity. The antenna can fit into a very compact space while providing circular polarization over the desired bands of the antennas that are isolated.

15 Claims, 6 Drawing Sheets

HIGHLY ISOLATED DUAL COMPACT STACKED SPIRAL ANTENNA

TECHNICAL FIELD OF THE INVENTION

This invention relates to the field of microwave antennas, and more particularly to a multiple frequency band antenna with isolation between the bands. The invention is related to commonly assigned U.S. Pat. Nos. 5,936,594 and 5,990,849, the entire contents of which are incorporated herein by this reference.

BACKGROUND OF THE INVENTION

Antennas having the capability of multiple frequency band operation are known in the art. It is desirable to provide isolation between the multiple frequency bands. Conventionally this is done by filtering the bands by filters outside the antenna body, which requires added hardware and space.

It is known to use a spiral antenna for one band, with other spiral antennas placed at the edges of larger spirals. The outer spiral is generally quite small and therefore must operate at a significantly different and higher frequency. If the spirals are close to the same frequency, they take up much more space and are therefore not a compact structure.

Generally, antennas that are spaced close to each other have considerable coupling which reduces the antennas's ability to separate out signals.

SUMMARY OF THE INVENTION

According to one aspect of the invention, an antenna is described which includes a plurality of antennas stacked on top of each other in a compact cavity. Input match and radiation gain can be enhanced by the application of a capacitor and inductor in the feed of the spiral lowest in the cavity. The antenna can fit into a very compact space while providing circular polarization over the desired bands of the antennas that are isolated.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
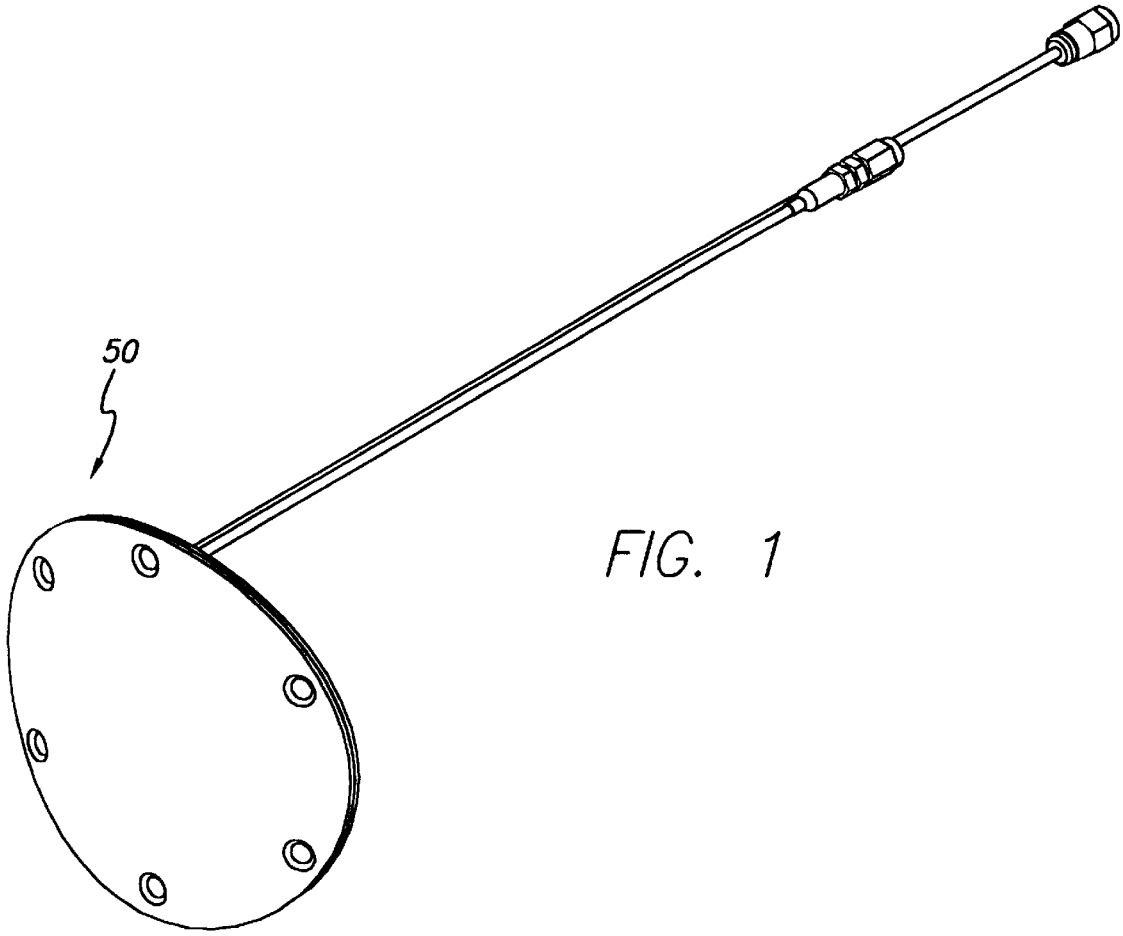
FIG. 1 is an isometric view of a multiple frequency band antenna embodying the invention.
Figure 3:
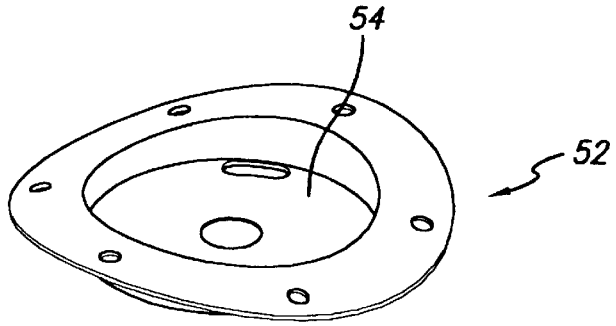
FIG. 3 is an isometric view of the housing structure for the antenna system.

An exemplary embodiment of a dual antenna system 50 embodying the invention is illustrated in FIGS. 1–7. The antenna system includes a housing structure 52 formed of aluminum or other suitable conductive material, and defining a shallow cavity 54, as shown in FIG. 3. The cavity 54 is of sufficient depth to receive the antenna radiating structures, as will be described in further detail below.

A radome 56 fits over the housing cavity when the antenna has been assembled, and is fabricated of a fiberglass or other low dielectric material. The antenna radiating structures are sandwiched together to form an assembly 60, and fitted into the cavity 54.

Figures 2A, 2B:
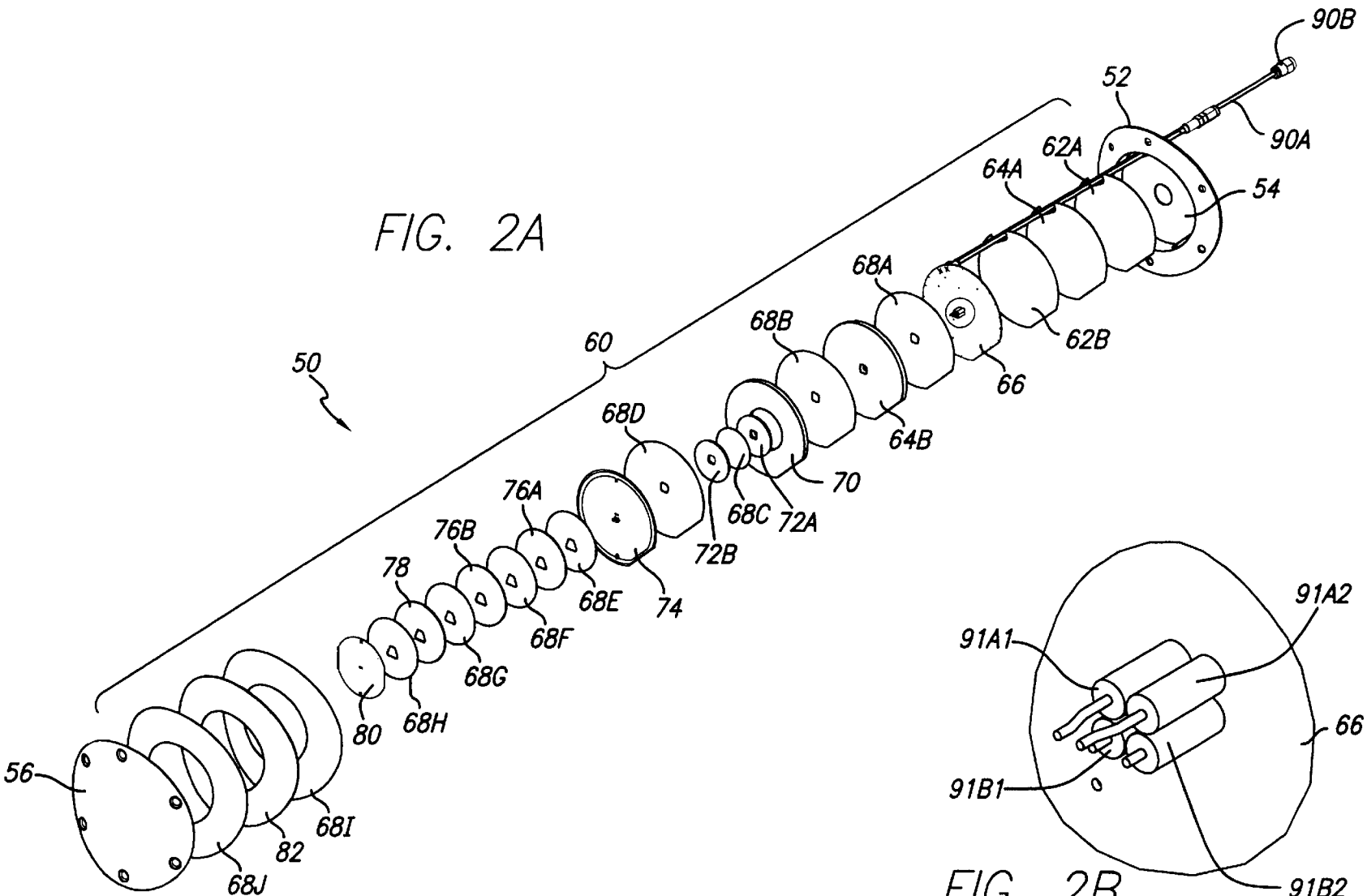
FIG. 2 is an exploded isometric view of an exemplary implementation of a multi-band spiral antenna embodying the invention.

Shown in the exploded isometric view of FIG. 2A are the various elements of the assembly 60. Insulation layer 64A is adhered to the bottom surface of the housing 52 by epoxy layer 62A. A balun circuit layer 66 is adhered by epoxy layer 62B to the insulation layer 64A. A high dielectric spacer layer 64B is adhered to the opposite surface of the balun layer 66 by an adhesive film 68A.

A foam spacer ring 70 is adhered to the spacer layer 64B by adhesive film 68B. Aft spacer elements 72A, 72B are held in position between the in-board side of the first antenna 74 by adhesive films 68C and 68D. The first antenna 74 is fabricated as a flexible printed wiring board (PWB) structure in this exemplary embodiment.

The second antenna 80 is also a PWB structure, and is assembled forward of the first antenna 74. The second antenna 80 is separated from the forward surface of the first antenna by forward spacer layers 76A, 76B, with adhesive film 68E adhering the layer 76A to the forward surface of the first antenna 74, and adhesive film 68F adhering the spacer 76B to spacer 76A. An absorber layer 78 is supported between the spacer 76B and the aft surface of the second antenna 80 by adhesive films 68G and 68H.

A forward absorber structure 82 in the form of an annular ring structure is assembled to the forward periphery of the second antenna 80 by annular adhesive film 68I. Another annular adhesive film 68J adheres the forward absorber structure to the periphery of the aft surface of the radome 56.

The high dielectric spacer layer 64B is used to increase the phase delay of any energy that gets past the spiral circuit 74I on the back surface of the lower antenna 74. Ideally, a 90 degree phase shift through the high dielectric spacer is desirable. The energy that gets past the lower antenna will go through the high dielectric spacer 64B (90 degree phase shift), reflect off the back of the conductive cavity (180 degree phase shift), and pass through the high dielectric spacer 64B again (90 degree phase shift) for a total phase shift of 360 degrees. The energy will now radiate out the front of the antenna in phase with the forward radiating energy.

The foam spacer ring 70 is used as a low dielectric, low cost, high temperature spacer used to set the proper distance from the back of the lower antenna to the front of the filter/balun.

The aft spacer elements 72A, 72B are used to transfer heat from the front of the antenna towards the back. The aft spacer elements are not required for proper antenna operation. For example, a solid foam spacer could alternatively be employed.

The forward spacer layers 76A, 76B in this exemplary embodiment are used to transfer heat from the front of the antenna towards the back. The absorber layer 78 is used to reduce the gain of the upper antenna for an exemplary application. The forward spacer layers and the absorber layer can be replaced by any low dielectric material that provides the proper spacing between the back of the upper antenna and the front of the lower antenna.

The forward absorber 82 improves antenna performance for an exemplary application, by eliminating ripple in the spiral antenna patterns caused by the excitation of surface currents on the surrounding metal cavity that the antennas reside in.

FIG. 2B is an enlarged view of a portion of the balun 66, showing cables 91A1, 91A2 which feed the upper antenna 80 and cables 91B1, 91B2 which feeds the lower antenna 74. These cables are semi-rigid coaxial cables in this exemplary embodiment. Cables 91A are soldered to the balun 66 on one end, and to the upper spiral antenna 80 on the other end. Two cables are required per antenna, one cable per spiral arm. Cables 91A1, 91A2 passes through clearance holes in the lower spiral antenna en route to the upper spiral antenna. Cables 91B1, 91B2 are soldered to the balun on one end and to the lower spiral antenna on the other end.

Cable assembly 90A and 90B provide the external connection for the antenna, one cable for each spiral antenna. They are soldered to their respective launch ports on the balun, as will be described more fully below with respect to FIG. 7. The other end of the cables will attach to a transmitter or receiver as required for a particular application.

Figure 4C:
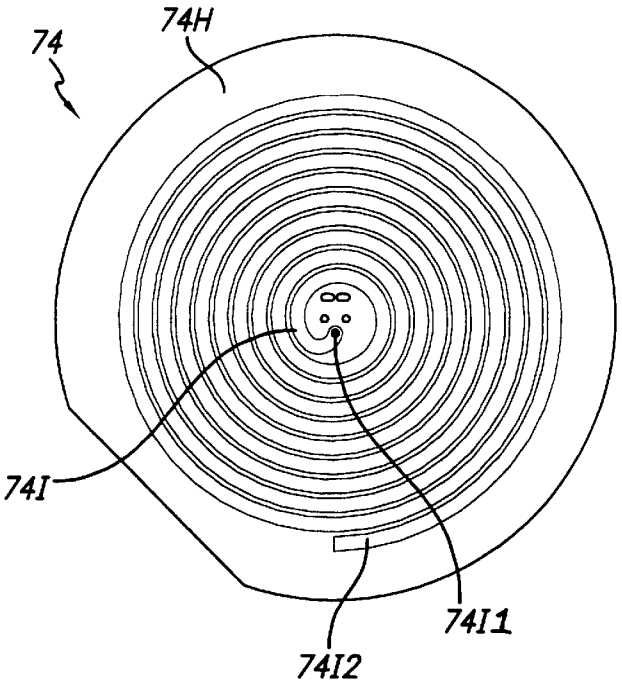
FIGS. 4A–4C illustrate the aft antenna printed wiring board, with FIG. 4A a top view, FIG. 4B an enlarged view of the center region of the surface of FIG. 4A, and FIG. 4C a bottom view.
Figure 4B:
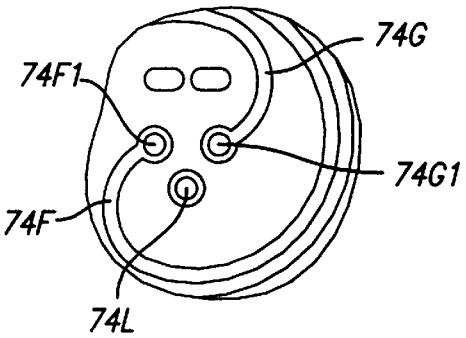
Figure 4A:
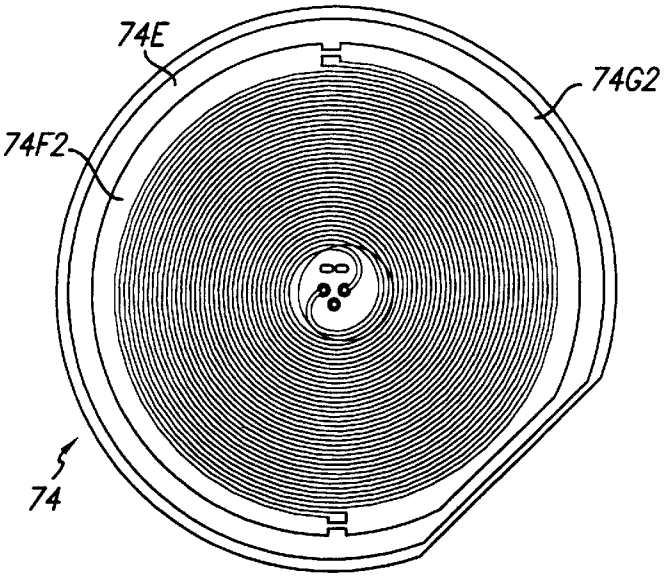

FIG. 4A is a top view of the PWB 74 carrying the lower spiral antenna, with surface 74E, the forward surface when the PWB is installed. The PWB 74 has formed thereon spiral-wound circuit traces 74F and 74G emanating from the center region from interior terminations 74F1 and 74G1 (FIG. 4B) to outer peripheral band regions 74F2 and 74G2, respectively. In this exemplary embodiment, the circuit traces have a width of 0.02 inch, although this will of course depend on various application factors such as the frequency band of operation for the antenna formed by the PWB 74, as is well known in the art. In this exemplary embodiment, the PWB antenna 74 operates in the C-band frequency range.

FIG. 4B shows the connection of the lower spiral antenna, with two cables 91B soldered to ports 74F1 and 74G1. Port 74L is a plated through hole that connects for the spiral 74I on the back of the lower antenna. The inductor 74J (FIG. 6) is soldered from port 74F1 to port 74L. The capacitor 74K (FIG. 4B) is soldered from port 74G1 to port 74L.

The opposite surface 74H of the PWB 74 is shown in FIG. 4C, and has formed thereon a conductor circuit trace 74I in a spiral pattern emanating from the center region of the PWB from an interior termination 74I1 to an outer trace termination 74I2. Spiral 74I reflects energy which is radiated toward the back of the cavity forward, out of the cavity. The trace has a width of 0.060 inch in this exemplary embodiment.

An inductor 74J and capacitor 74K are connected to the antenna at the center of the PWB 74, and control the phase to the respective spiral arms 74F and 74G of the aft antenna, enhancing gain and reducing the axial ratio. The inductor 74J is soldered from one spiral arm, 74G on the front surface of the PWB 74 to a solder pad that connects to the spiral arm 74I on the back surface of the PWB 74. The capacitor 74K is soldered from the opposite spiral arm 74f to the same solder pad that connects to the spiral arm 74I on the lower antenna.

A resistor 74B and capacitor 74C are soldered from one end of the spiral arm 74G to a conductive ring 74G2 encircling the spiral arms 74F, 74G. The capacitor 74C helps control the phase of the arm. The resistor 74B absorbs energy that is not radiated by the time it gets to the end of the spiral arm, eliminating destructive reflections in the spiral antenna. Both the resistor 74B and the capacitor 74C further reduce the axial ratio of the antenna. A resistor 74D is soldered from the end of the opposite spiral arm 74F to the conductive ring 74G2 encircling the spiral antenna, and also absorbs energy not radiated by the time it reaches the end of the spiral arm 74F, eliminating destructive reflections in the spiral antenna, and further reducing the axial ratio of the antenna.

As with the lower spiral antenna 74, there are resistors 80G, 80F soldered between the respective spiral arms 80B, 80C to absorb any unradiated energy, preventing destructive reflections and improving the axial ratio of the antenna.

Figure 5A:
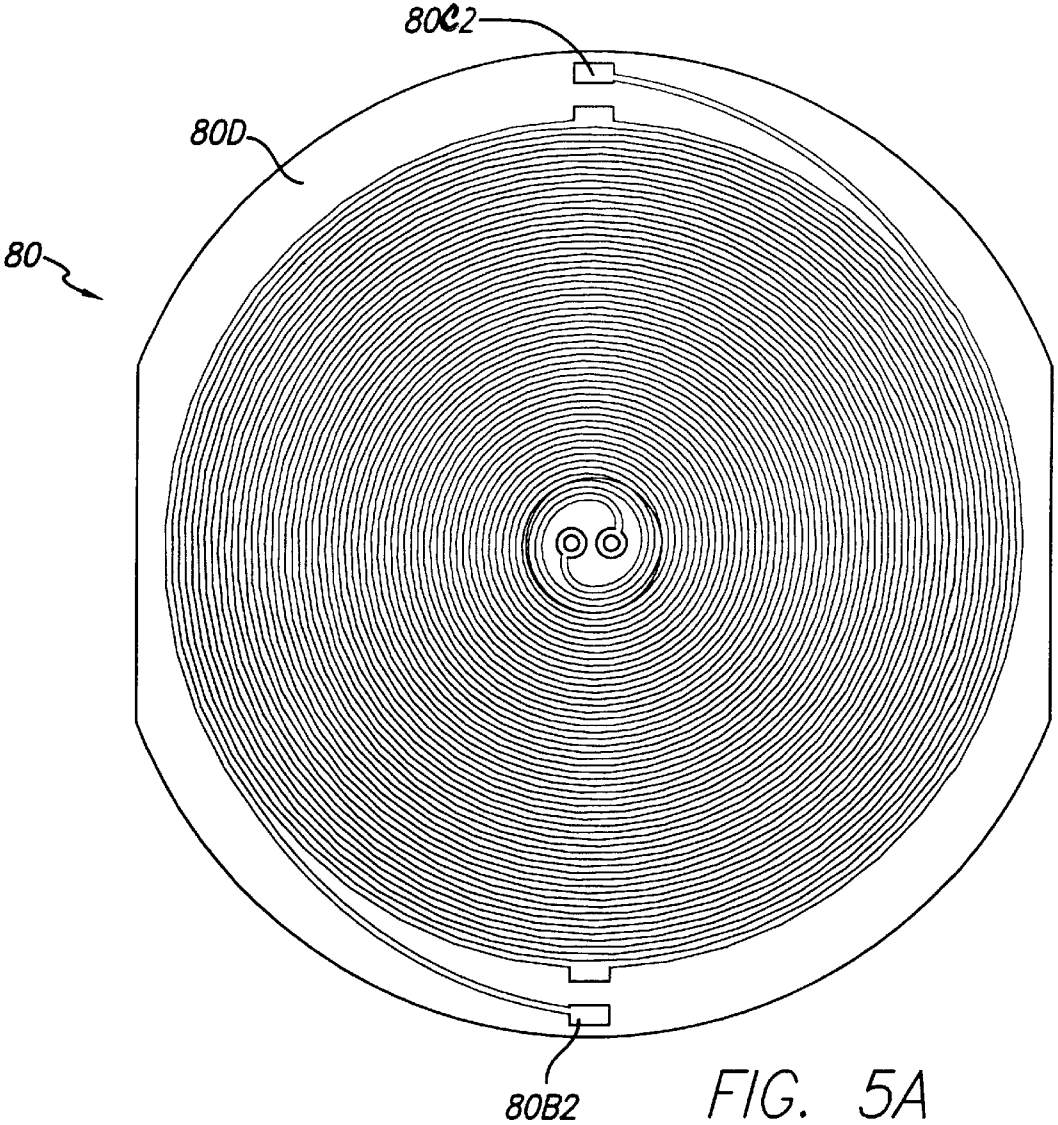
FIGS. 5A and 5B illustrate the forward antenna printed wiring board, with FIG. 5A a top view and FIG. 5B an enlarged view of the center region of the surface of FIG. 5A.
Figure 5B:
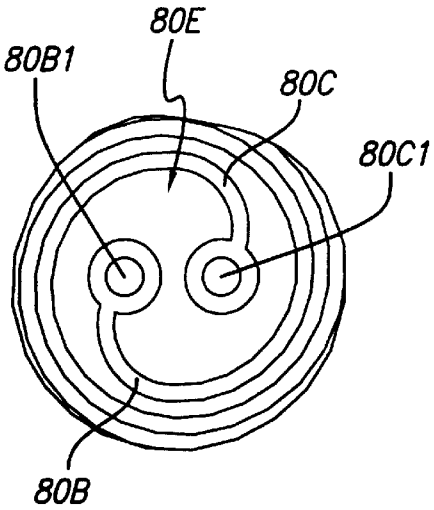

FIG. 5A is a front view of the upper spiral antenna on PWB 80, with FIG. 5B an enlarged view of the center area of the patterned surface of the PWB. The surface 80D of the PWB has formed thereon spiral-wound circuit traces 80B and 80C emanating from the center region from interior terminations 80B1 and 80C1 to outer termination pads 80B2 and 80C2, respectively, to which resistors 80G and 80F are soldered. In this exemplary embodiment, the circuit traces have a width of 0.01 inch, although this will of course depend on various application factors such as the frequency band of operation for the antenna formed by the PWB 80, as is well known in the art. In this exemplary embodiment, the PWB 80 antenna operates in the S-band frequency range.

Figure 6:
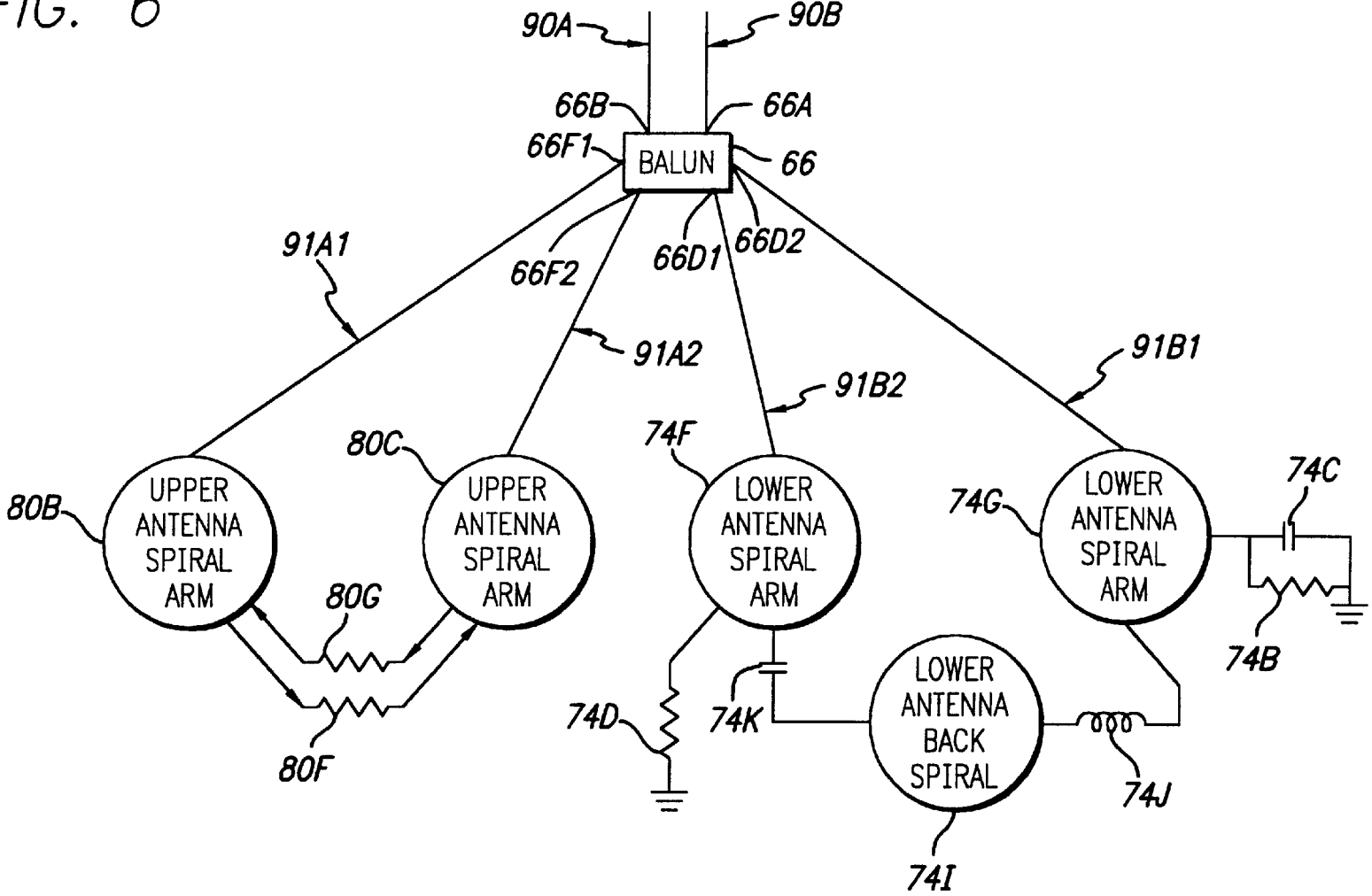
FIG. 6 is a simplified schematic diagram of the antenna system 50.

FIG. 6 is a schematic diagram of the system 50, showing the electrical connections between the two antennas through the balun 66. Cable 90A is connected to port 66B of the balun, and provides the excitation for the upper antenna 80 from a transmitter in the case of transmit operation, or is connected to a receiver in the case of receive operation. Similarly, cable 90B is connected to port 66A of the balun, and provides the excitation for the lower antenna 74 in the case of transmit operation, or is connected to a receiver in the case of receive operation. The balun 66 provides a coupling from port 66A to ports 66F1 and 66F2, such that a 180 degree phase delay difference is introduced in the respective electrical paths between port 66B and port 66F1 and between port 66B and port 66F2. Similarly, the balun 66 provides a coupling from port 66A to ports 66D1 and 66D2, such that a 180 degree phase delay difference is introduced in the respective electrical paths between port 66A and port 66D1 and between port 66A and port 66D2.

The balun 66 takes the energy from the coaxial cables 90A, 90B and delivers the energy to the individual arms of the spirals with a 180 degree phase difference between the arms. A broadband balun can be used for broadband operation. A filter is incorporated into the transmission line for the upper antenna that rejects the signal from the lower antenna, by greater than 65 dB in this exemplary embodiment.

Figure 7:
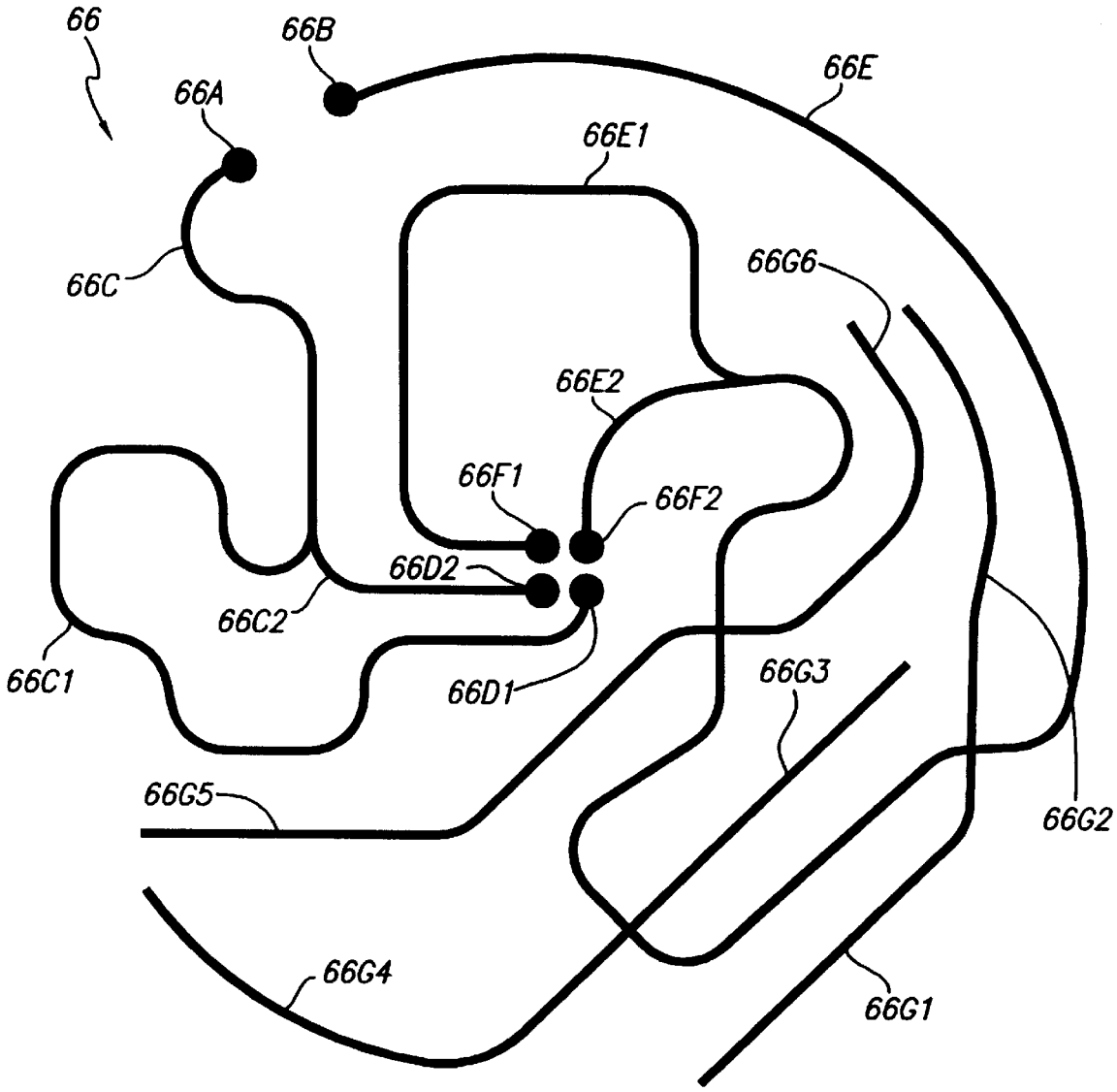
FIG. 7 illustrates an exemplary printed wiring pattern for an exemplary balun circuit for the antenna system.

The balun 66 is fabricated in this exemplary embodiment as a printed wiring board with outer ground planes sandwiching through dielectric spacer layers a wiring pattern indicated in FIG. 7. Here, port 66A is at one end of a wiring trace 66C, which divides into two trace segments 66C1 and 66C2. Ports 66D1 and 66D2 are at the respective distal ends of the trace segments 66C1 and 66C2. Segment 66C1 has an effective electrical length which is longer than the effective electrical length of segment 66C2 by one-half wavelength at the center frequency of operation of antenna 74. Port 66B is at one end of wiring trace 66E, which divides into two trace segments 66E1 and 66E2. Ports 66F1 and 66F2 are at the respective distal ends of the trace segments 66E1 and 66E2. Segment 66E1 has an effective electrical length which is longer than the effective electrical length of segment 66E2 by one-half wavelength at the center frequency of operation of antenna 74.

The balun 66 further includes a filter provided by pairs of open-circuited stubs 66G1–66G6 extending from trace 66E.

The pairs of stubs are spaced at one-half wavelength spacings at the center of the frequency band of operation of antenna 80. This filter is optional, and could be eliminated for some applications, including a receive-only system.

The two spiral antennas 74, 80 provide circular polarization. The cavity 54 defined by the housing 52 can be relatively shallow, e.g. on the order of 4% of the wavelength at the lowest frequency of operation. Normally, a spiral would require a cavity depth of about 25% of the wavelength at the lowest frequency of operation. Factors which contribute to the reduction in depth of the cavity include the use of the spiral on the back of the lower spiral antenna, and the use of the capacitors and resistors in the lower antenna.

Another advantage of the dual band antenna of this invention is that the two antennas are highly isolated even though they are separated only by a very short distance, e.g. a 0.03 inch spacing in this exemplary embodiment. Greater than 65 db of isolation can be achieved in one embodiment. Further, the input match and radiation gain are enhanced by the application of the capacitors 74C, 74K and inductor 74J at the feed of the spiral lowest in the cavity.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A multiple frequency band antenna system with isolation between multiple frequency bands of operation, comprising:

a conductive housing structure defining a shallow cavity;

a first spiral antenna comprising first and second spiral arms defined on a first printed wiring board and wound around a center axis, each arm having a feed end and a terminated end, said first spiral antenna for operation at a first frequency band;

a second spiral antenna comprising third and fourth spiral arms defined on a second printed wiring board and wound around said center axis, each spiral arm having a feed end and a terminated end, said second spiral antenna for operation at a second frequency band which is lower in a frequency range than a corresponding frequency range of the first frequency band;

said first and second printed wiring boards arranged in a stacked, isolated arrangement within said cavity.

2. The system of claim 1, further comprising a balun circuit, comprising a first balun for connecting a first frequency band drive signal to said first spiral antenna, said first balun including a first transmission line circuit for connecting said first drive signal to said respective feed ends of said first and second spiral arms of the first spiral antenna, a second balun for connecting a second frequency band drive signal to said second spiral antenna, said second balun including a second transmission line circuit for connecting said second drive signal to said respective feed ends of said third and fourth spiral arms of the second spiral antenna.

3. The antenna system of claim 1 further comprising a dielectric radome structure attached to the housing structure and covering the cavity and said first and second spiral antennas.

4. The antenna system of claim 1 wherein said first and second spiral arms of said first antenna are on a first surface of said first printed wiring board, and wherein a fifth spiral arm is on a second surface of said first printed wiring board, said third spiral being substantially underneath at least one of said first and second spiral arms so as to at least partially cover at least one of said first and second spiral arms.

5. The antenna system of claim 4 further comprising an inductor-capacitor circuit coupling the first and second spiral arms of said first antenna to said fifth spiral arm.

6. The antenna system of claim 1 wherein said first spiral antenna is disposed in the cavity beneath the second spiral antenna.

7. The antenna system of claim 1, wherein said first frequency band is in the C frequency band, and the second frequency band is in the S frequency band.

8. The antenna system of claim 1 further comprising an RF absorber structure disposed forward of said second spiral antenna.

9. The antenna system of claim 8 wherein said RF absorber structure comprises a generally annularly shaped structure.

10. A multiple frequency band antenna system with isolation between multiple frequency bands of operation, comprising:

a conductive housing structure defining a shallow cavity;

a first spiral antenna comprising first and second spiral arms defined on a first printed wiring board and wound around a center axis, each arm having a feed end and a terminated end, said first spiral antenna for operation at a first frequency band;

a second spiral antenna comprising third and fourth spiral arms defined on a second printed wiring board and wound around said center axis, each spiral arm having a feed end and a terminated end, said second spiral antenna for operation at a second frequency band which is lower in a frequency range than a corresponding frequency range of the first frequency band;

a balun circuit, comprising a first balun for connecting a first frequency band drive signal to said first spiral antenna, said first balun including a first transmission line circuit for connecting said first drive signal to said respective feed ends of said first and second spiral arms of the first spiral antenna, a second balun for connecting a second frequency band drive signal to said second spiral antenna, said second balun including a second transmission line circuit for connecting said second drive signal to said respective feed ends of said third and fourth spiral arms of the second spiral antenna; and wherein said balun, said first printed wiring board and said second printed wiring board are arranged in a stacked arrangement within said cavity.

11. The antenna system of claim 10 further comprising a dielectric radome structure attached to the housing structure and covering the cavity and said first and second spiral antennas.

12. The antenna system of claim 10 wherein said first and second spiral arms of said first antenna are on a first surface of said first printed wiring board, and wherein a fifth spiral arm is on a second surface of said first printed wiring board, said third spiral being substantially underneath at least one of said first and second spiral arms so as to at least partially cover at least one of said first and second spiral arms.

13. The antenna system of claim 12 further comprising an inductor-capacitor circuit coupling the first and second spiral arms of said first antenna to said fifth spiral arm.

14. The antenna system of claim 10 wherein said first spiral antenna is disposed in the cavity beneath the second spiral antenna.

15. The antenna system of claim 10, wherein said first frequency band is in the C frequency band, and the second frequency band is in the S frequency band.

* * * * *

UNITED STATES PATENT AND TRADEMARK OFFICE

CERTIFICATE OF CORRECTION

PATENT NO. : 6,300,919 B1
APPLICATION NO. : 09/578133
DATED : October 9, 2001
INVENTOR(S) : Michael S. Mehen et al.

It is certified that error appears in the above-identified patent and that said Letters Patent is hereby corrected as shown below:

Col. 1 lines 3-4, above the TECHNICAL FIELD OF THE INVENTION paragraph, please insert the following paragraph:

--STATEMENT REGARDING FEDERALLY SPONSORED RESEARCH OR DEVELOPMENT

This invention was made with Government support under N00024-95-C-5400 awarded by The Department of the Navy. The Government has certain rights in this invention.--

Signed and Sealed this
Twenty-fourth Day of April, 2012

David J. Kappos

David J. Kappos
*Director of the United States Patent and Trademark Office*